US005921743A

United States Patent [19]

Slagter

[11] Patent Number: 5,921,743

[45] Date of Patent: Jul. 13, 1999

[54] DUMP ATTACHMENT

[76] Inventor: Rodney Slagter, 1673 E. Tugalo St., Toccoa, Ga. 30577

[21] Appl. No.: 08/989,109

[22] Filed: Dec. 11, 1997

[51] Int. Cl.[6] ..... E02F 9/00

[52] U.S. Cl. ..... 414/722; 298/5; 298/22 R

[58] Field of Search ..... 414/421, 685, 414/703, 722, 920; 298/5, 22 R

[56] References Cited

U.S. PATENT DOCUMENTS

| | | | |
|---|---|---|---|
| 2,752,193 | 6/1956 | Kling | 298/5 |
| 2,981,428 | 4/1961 | Noffsinger | 414/722 |
| 3,065,566 | 11/1962 | Kampert | 37/117.5 |
| 3,205,011 | 9/1965 | Diem | 298/22 R X |
| 3,330,429 | 7/1967 | Kress . | |
| 3,481,056 | 12/1969 | Meade et al. | 37/117.5 |
| 3,878,959 | 4/1975 | Holdeman et al. . | |
| 4,080,746 | 3/1978 | Frazzini | 414/722 X |
| 4,802,709 | 2/1989 | Jones | 414/421 X |
| 5,618,155 | 4/1997 | Tighe | 414/912 X |

*Primary Examiner*—Donald W. Underwood
*Attorney, Agent, or Firm*—Henry S. Jaudon; Cort Flint

[57] ABSTRACT

A detachable dump bucket assembly for selective attachable with a skid steer loader. The assembly includes a substantially rigid frame having side rails connecting with opposed ends of front and rear rails. An attachment frame which is operative to connect with the lift arms of the loader is connected with the rear rail of the frame. A pair of swivel support wheels and a support axle are connected with a teeter-totter mounting with the front rail of the frame. A hydraulically controlled dump bucket is provided and pivoted about the front rail between a carry position and a dump position. The assembly, when attached with the lift arms of the loader, is capable of carrying and dumping material weighing at least two times the weight of the loader. It is also capable of being raised by the lift arms into an elevated position for carried movement.

13 Claims, 2 Drawing Sheets

DUMP ATTACHMENT

BACKGROUND OF THE INVENTION

The instant invention is directed to an improved dump bucket assembly for use with skid drive loaders.

In construction work involving buildings, parking lots, and other small jobs, the use of skid drive loaders and power buggies is common due to their size, versatility and relative low cost. In substantially all of these projects skid drive loaders are essential for moving, stacking, and loading materials as well as scraping and trenching.

Jobs which include pouring of concrete usually involve hand pushed dump buckets or dump buckets mounted on power buggies. Either arrangement is not completely satisfactory due to the high cost of labor or the high cost of the powered dump bucket which has limited functional use. This problem is intensified as concrete is poured sporadically which creates periods of idle time for men and or equipment.

Attempts have been made to overcome this problem by providing attachments for connecting with the skid steer loader, thus eliminating the cost of additional equipment and gaining maximum use of equipment on hand.

Because the skid steer loader possesses flexibility and power and because it is an essential piece of equipment, numerous attachments, in addition to its primary lifting attachment, have already been developed. Among these attachments is a bucket chute, a cable plow, a dozer, a roller, a tiller, a trencher, and a mixer. Each of these attachments include one common feature, that is they function with a single power source, i.e., the loader. In instances where the lift arms support the attachment, such as with the mixer and the bucket, their weight capacity is limited to less than the weight which would cause the loader to tilt forwardly.

The average skid steer loader weighs about 4,500 pounds and has an average capacity of 1,250 pounds.

It is an object of this invention to provide a dump bucket attachment for a skid steer front end loader capable of carrying up to eight times the normal load capacity of the loader.

Another object of the invention is to provide a dump bucket attachment assembly specifically designed to transport concrete.

Another object of the invention is to provide a dump bucket assembly capable of being positioned in a work position and a raised transport position.

Another object of the invention is a dump bucket assembly having a hydraulic system actuated by the hydraulic system of the loader.

Another object of the invention is to provide an attachment assembly which functions to maximize the work potential of a skid steer loader.

SUMMARY OF THE INVENTION

The instant invention is directed to a detachable dump bucket assembly for selective attachment with a skid steer loader. The assembly includes a frame pivotally supporting a dump bucket at one end thereof. A hydraulic assembly connects with the bucket and the frame and is operative to move the bucket between a dump position and a carrying position. The hydraulic assembly includes a pair of hydraulic cylinders which are mounted on the frame and are connected with the bucket. Supply lines connect the cylinders with the hydraulic system of the loader.

A teeter-totter system comprising an axle pivotally mounted centrally of the front of the frame is provided. The axle carries a pair of wheels at its opposed ends. The teeter-totter system allows the assembly to tilt left and right in response to the terrain.

A connector which is secured with the rear end of the frame is operative to attach the assembly with the forward ends of the lift arms of the loader. The connector comprises a pair of spaced vertically extending rods which are adapted to engage in a fixed position with a pair of flanges secured with the ends of the lift arms. The rods are pivotally mounted with upper rails of the rear end of the frame which allows pivotal movement between the assembly and the loader along a vertical plane. A lower of the rear rails is adapted to serve as a bump stop which serves to limit the pivotal movement of the frame and acts with the connector rods to allow the assembly to be lifted into a raised position by the lift arms. In the raised position the assembly may be easily transported between positions.

A hydraulic system, which is a part of the standard equipment of the loader, is connected with the hydraulic assembly and operates to actuate that assembly to pivot the bucket about its pivot between a dump position, in which the bucket is raised, and a load position, in which the bucket is lowered. The hydraulic system also acts to move the lift arms between positions. In a first position the lift arms place the assembly in its work position in which the wheels are on the ground and assist in supporting the load. In this position the wheels allow the load capacity to be increased to at least eight times the normal load capacity of the loader. In a second position the lift arms elevate the assembly into a raised position which provides for easy transport.

The dump bucket is at least 5 feet wide, 3 feet deep and has a 9,000 pound capacity.

DESCRIPTION OF A PREFERRED EMBODIMENT

Figure 1:
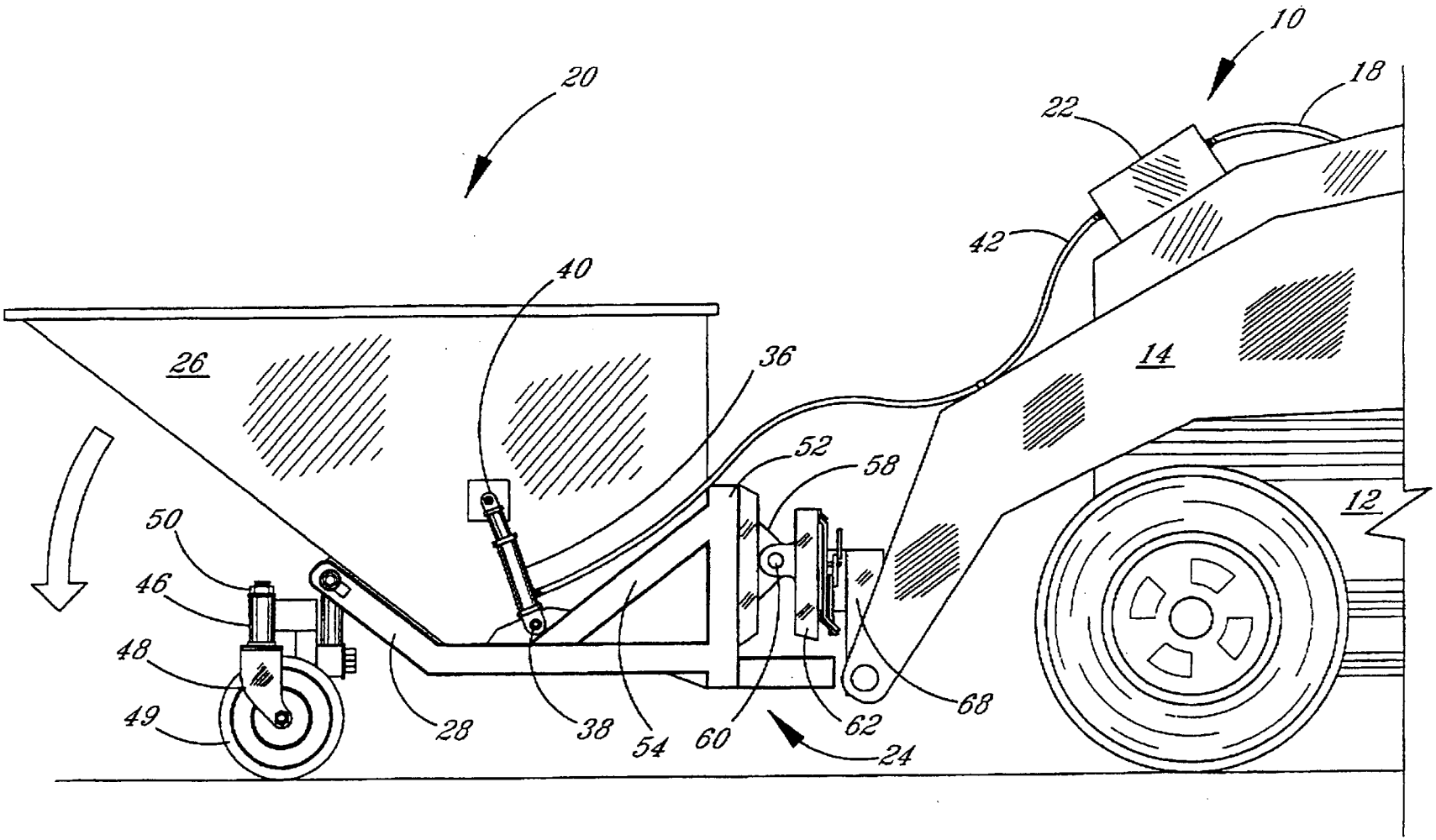
FIG. 1 is a side view of the dump bucket assembly of the invention connected with the arms of a skid steer loader.

Turning now to FIG. 1, the primary embodiment of the attachable dump bucket assembly of the invention is shown attached with the front ends of the lift arms of a skid steer loader. The loader could be any brand provided by any manufacturer, however, the BOBCAT skid steer loader is of primary interest.

Figure 2:
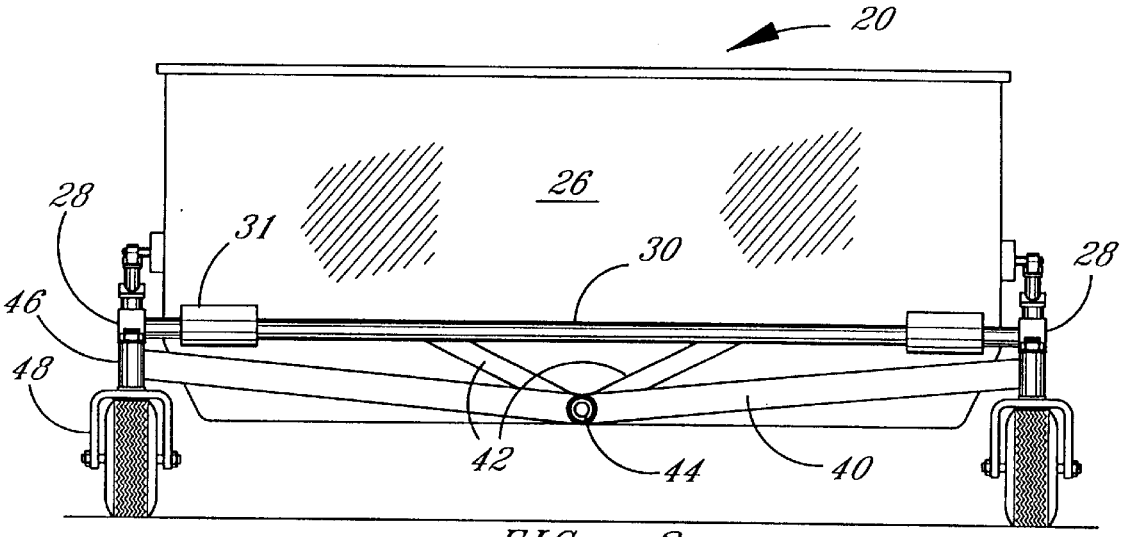
FIG. 2 is an end view showing the front of the assembly.
Figure 3:
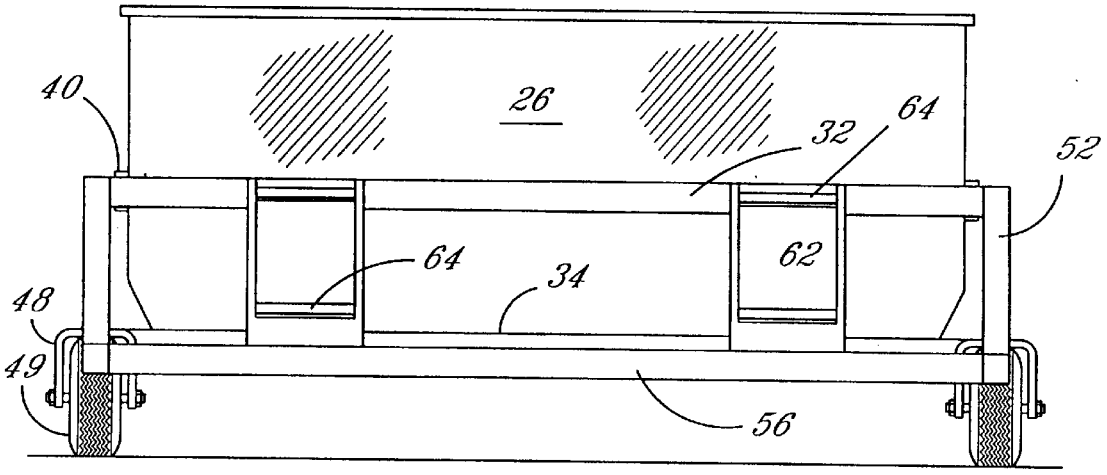
FIG. 3 is an end view showing the rear of the assembly.

As shown in FIGS. 1–3, loader 10 includes a body portion 12 having four drive wheels (only one is shown) and a pair of spaced lift arms 14. An operator area includes the steering mechanism and a control for the hydraulic system. The hydraulic system functions to raise and lower lift arms 14 and to control the hydraulic feed through supply lines 18 and connector 22 which function normally to control the position of a blade or scoop attached with the lift arms.

The dump bucket assembly of the invention is identified as 20 and includes frame 24 which carries dump bucket 26. Frame 24 includes a pair of side rails 28, a front rail 30, and a pair of rear rails 32, 34. Each side rail 28 pivotally mounts at 38 a hydraulic cylinder 36 at one end. The opposite and piston end of cylinders 36 are pivotally mounted at 40 to a side of dump bucket 26. Supply lines 42 connect cylinders 36 with the hydraulic system by way of connector 22.

Front rail 30 is connected at opposite ends with side rails 28 and support axle 40 through a pair of braces 42 which come together below and at its center. Axle 40 is pivotally mounted with braces 42 at pivot 44 forming a teeter-totter suspension for assembly 20. Each end of axle 40 is formed with a swivel bearing 46 which receives a vertical extension 50 of wheel mount 48. This allows 360° movement of wheels 49.

The rear end of frame 24 includes a pair of vertical extensions 52 connected with end portions of rails 28. A brace 54 maintains extensions 52 in a vertical position. An upper rear rail 32 is secured at each end with an extension 52 a short distance from its upper end. Lower rear rail 34 is attached with the ends of side rails 28 and the lower ends of extensions 52. A bumper 56 is secured along the outer rear face of rear rail 34.

Figure 4:
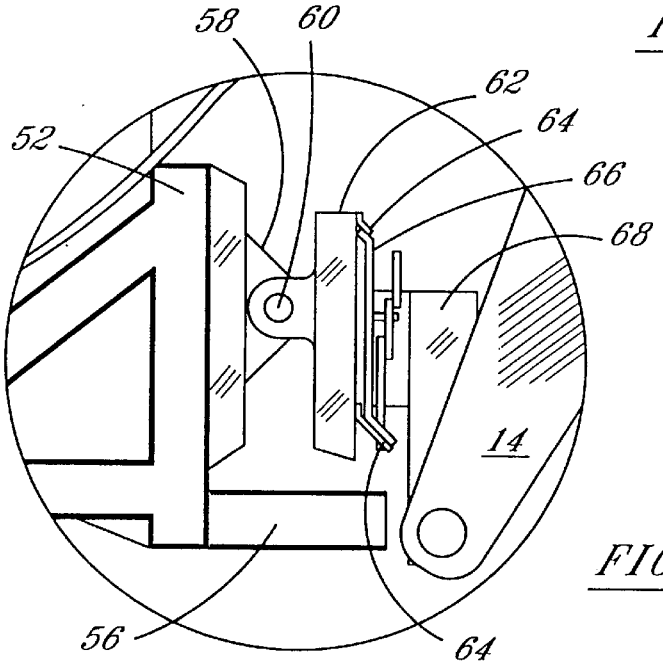
FIG. 4 is a sectional side view showing the connecting assembly.

An attachment assembly, best seen in FIGS. 1 and 4, is provided at the rear end of frame 24. The attachment assembly includes a pair of brackets 58 formed with pivots 60 at their center. First ones of brackets 58 are secured with rails 32, 34 in spaced positions equal the spacing of lift arms 14. Each of the opposite ones of brackets 58 connect with an elongated rod 62. The opposite side of each rod 62 mounts a pair of spaced extensions 64. Extensions 64 are designed to releasable engage with attachment members 66 formed with vertical supports 68 which are carried by the ends of arms 14. This is a known attachment system as shown in the cited publication, *Bobcat Loader Basics*.

Pivots 60 allow pivoting movement along a vertical plane between loader 10 and assembly 20. Bumper 56 is positioned to engage with the lower ends of arms 14 and vertical supports 68 limiting downward pivotal movement of assembly 20. Bumper 56, in addition to forming a stop limiting the pivotal motion of assembly 20, also functions to engage with arms 14 to lift the assembly into a raised position. In the raised position, the assembly may be easily transported.

Bucket 26 is formed with vertical rear and side sections and a slanted front section and sits between side rails 28 and front rail 30 and rear rails 32,34. Bucket 26 is pivotally attached to front rail 30 brackets at pivots 31. The rear edge of bucket 26 may rest on a portion of lower rear rail 34. Bucket 26 is formed to be between 5' and 5½' wide and 6' long at its upper edge. It is designed to accommodate a load of concrete which is at least eight times the normal capacity of a conventional skid drive loader which is about 4,500 pounds or which is about two times the weight of the loader.

In the position shown in FIG. 1, bucket 26 is in its load position. The dump position is attained by actuating cylinders 36 to raise and pivot bucket 26 about pivots 31. When cylinders 36 are fully extended, bucket 26 is in its dump position.

In operation, with assembly 20 attached to loader 10, levers 14 are actuated to lift the assembly to its raised position. In this position movement of loader 10 carrying assembly 20 is exactly the same as the movement of any standard attachment connected with and transported by loader 10. When loader 10 has transported assembly 20 to a loading area, arms 14 are controlled to lower the assembly into its load position with wheels 49 firmly grounded. Concrete or other loose material is poured into bucket 26. As bucket 26 fills, the weight of the load is distributed between wheels 49 of assembly 20 and the wheels of loader 10. This system allows a load weighing at least eight times that normally carried, or about 9,000 pounds, to be loaded into bucket 26. When filled, loader 10 may push or pull assembly 20 to a desired dump position. The connection by way of brackets 58 and pivots 60 allows vertical pivoting movement between assembly 20 and loader 10 but allows no relative side-to-side movement. The teeter-totter assembly of the front axle allows wheels 49 to remain firmly on the ground even though the terrain supporting the wheels 49 may be different from that supporting the loader. The swivel mounting for wheels 49 allow loader 10 to perform turns and changes in direction in the usual manner with assembly 20 easily following along. Upon reaching the desired location, assembly 20 is positioned with the front end adjacent the dump area. The hydraulic system is controlled to actuate cylinders 36 and bucket 26 is pivoted into its dump position. After the load is deposited, bucket 26 is lowered and the process is repeated.

The invention provides an inexpensive and efficient manner for transporting larger than normal quantities of loose material while not requiring additional of equipment.

While a preferred embodiment of the invention has been described using specific terms, such description is for illustrative purposes only, and it is to be understood that changes and variations may be made without departing from the spirit or scope of the following claims.

What is claimed is:

1. A detachable dump bucket assembly for selective attachment with a skid steer loader having a hydraulic system and a pair of spaced lift arms comprising:

a dump bucket;

a frame for supporting said dump bucket;

pivotal mounting members for pivotally securing one side of said bucket with a first end of said frame;

a hydraulic assembly connected between said frame and said bucket and connectable with said hydraulic system, said hydraulic assembly being operative to move said bucket between a dump position in which said bucket is raised and a load position in which said bucket is lowered;

a pivot connected with said frame, said pivot mounting an axle for pivotal movement relative said frame, said axle mounting wheels at its opposed ends;

a connector secured with a second end of said frame, said connector being operative to pivotally secure said assembly with said spaced lift arms of said loader; whereby, said hydraulic system, may be controlled to cause said hydraulic assembly to pivot said bucket about said pivot mounting between said dump position and said load position and to move said lift arms to position said assembly between a work position in which said wheels assist in supporting said assembly and a raised position in which said wheels are elevated.

2. The dump bucket assembly of claim 1 wherein swivel bearings mount said wheels with said axle.

3. The dump bucket assembly of claim 1 wherein said first end of said frame includes a front rail and said pivotal mounting members connect said bucket with said front rail.

4. The dump bucket assembly of claim 1 wherein said second end includes a pair of vertical beams carrying a pair of vertically spaced transverse rear rails, said connector including a pair of pivotally connected brackets with first ends of said brackets being mounted with said upper rail.

5. The dump bucket assembly of claim 4 wherein second ends of said brackets mount vertically extending rods, said rods being adapted to secure, in a fixed position, with extensions carried by ends of said lift arms, said pivotal connection allowing pivotal movement between said assembly and said loader along a vertical plane.

6. The dump bucket assembly of claim 5 including a bump stop carried by said lower rail, said bump stop acting to limit said pivotal movement of said assembly, whereby said dump bucket assembly may be lifted to said raised position by elevating said arms.

7. The dump bucket assembly of claim 1 including hydraulic supply lines for releasably connecting said hydraulic assembly with said hydraulic system.

8. The dump bucket assembly of claim 7 wherein said hydraulic system includes a connector, said hydraulic lines being releasably connectable with said connector.

9. The dump bucket assembly of claim 1 wherein said hydraulic assembly includes a hydraulic cylinder connected with side rails of said frame and opposed sides of said dump bucket.

10. The dump bucket assembly of claim 1 wherein said dump bucket is at least 5 feet wide, 3 feet deep with a capacity of about 9,000 pounds.

11. A detachable dump bucket assembly for selective attachment with lift arms of a skid steer loader of known weight, said assembly being positionable in a work position and a carry position comprising:

a substantially rigid frame having a pair of side rails separated by a front rail connected with first ends of said side rails and a rear rail connected with second ends of said side rails;

a connector assembly carried by said rear rail and adapted to attach with lift arms of said loader;

at least one swivel bearing carried by said frame, said swivel bearing mounting a support wheel for 360° movement, said support wheel supporting at least a portion of said assembly in said work position;

a dump bucket pivotally mounted to said front rail by mounts permitting said dump bucket to pivot about said front rail between a dump position and a load position;

a hydraulic assembly including at least one hydraulic cylinder connected to said bucket and said frame, said at least one cylinder being operative to pivot said bucket about said front rail between said dump and said load positions when desired, wherein;

said dump bucket assembly, when attached with said lift arms and positioned in said work position may be filled at a filling location with material weighing about eight times the normal load capacity of said loader, moved by said loader to a selected location where said bucket is moved to said dump position dumping said material whereupon said bucket may be lowered to said load position and said dump bucket assembly returned to said filling location.

12. The dump bucket assembly of claim 11 wherein said at least one swivel bearing mounting a support wheel comprises a pair of axially spaced swivel bearings each mounting a support wheel.

13. The dump bucket assembly of claim 12 including a teeter-totter system comprising an axle pivotally mounted with a pivot carried by said frame, said axle mounting said pair of swivel bearings carrying said wheels, said teeter-totter system allowing said assembly multidirectional movement.

* * * * *